United States Patent [19]

Pomeroy

[11] Patent Number: 4,460,211

[45] Date of Patent: Jul. 17, 1984

[54] GEM HOLDER

[75] Inventor: William B. Pomeroy, 3846 Park La., Traverse City, Mich. 49684

[73] Assignees: William B. Pomeroy; Johana Pomeroy, both of Traverse City, Mich.

[21] Appl. No.: 424,880

[22] Filed: Sep. 27, 1982

[51] Int. Cl.[3] ..... B25B 7/02

[52] U.S. Cl. ..... 294/99 R; 294/16

[58] Field of Search ..... 294/99 R, 16, 1 R, 19 R, 294/31, 62, 15, 26, 29, 104, 25, 99 A; 132/46 R, 46 A, 48 R

[56] References Cited

U.S. PATENT DOCUMENTS 3,274,658 9/1966 Pile ..... 294/99 R 4,274,669 6/1981 Williams ..... 294/16

4,307,908 12/1981 Donaldson ..... 294/1 R

*Primary Examiner*—James B. Marbert

*Attorney, Agent, or Firm*—Michael L. Bauchan

[57] ABSTRACT

A gem holder is provided which includes a handle and a gem holding wire array attached to one end of the handle. Two wire loops which each have two substantially parallel wire sections are provided for resiliently holding a gem to facilitate examining the gem. In the first embodiment both loops are rigidly attached to the handle to receive a gem girdle between the loops. In a second embodiment one of the loops is rigidly attached to the handle and the other of the loops is slidably attached to the handle to accommodate various sized gems.

8 Claims, 7 Drawing Figures

GEM HOLDER

SUMMARY OF THE INVENTION

It is an object of this invention to provide an inexpensive tool for securely holding a gem to facilitate examination of the gem, including microscopic examination, with minimum obscuring of the examiner's view by the gem holding apparatus, achieved by four substantially parallel wire sections holding the gem.

It is the further object of this invention to provide a gem holder which is easily adjustable to accommodate gems of various sizes and which can be easily mounted in a microscope support for rotation and examination of the gem without repositioning the holder, achieved by two fixed parallel wire sections and two movable wire sections parallel to the fixed wire sections.

BACKGROUND OF THE INVENTION

Gems have been prized for centuries and are of many substances, one of the most common being diamonds. The value of a gem is effected by many factors, including its color, its cut, its clarity, and its carat weight. A small gem of perfect features can easily be worth more than a much larger gem of less perfect features. It is essential that gem dealers and consumers be able to closely examine a gem, preferably through use of magnifying glasses and microscopes, to appraise gems in addition to enjoying their natural beauty. It is common to cut gems into one of several forms, including marquise, emerald, round and pear-shaped. The narrow edge of a gem at its widest part after cutting is commonly called the gem girdle. The gem pavilion is the portion below the girdle and the gem crown is the portion above the girdle. A table is commonly found in the form of a flat surface in the crown closest to a viewer when the gem is in a mounting.

The tweezers and other gem holders in common use are not satisfactory as the holder is so large a substantial portion of the gem is blocked from view during examination and prevents effective microscopic examination of the gem. Gem holders which do not securely hold a gem facilitate accidental dropping of gems, resulting in their damage and loss. Sale 1,001,991, a U.S. Patent, describes a gem holding device using claws to hold the gem. This appartus is unwieldy and so complex as to be cumbersome.

Various holding devices having an elongated handle with a wire array to hold objects have previously been invented, some being Seeger U.S. Pat. No. 3,743,338, a U.S. Pat. No. 2,116,651, Ackerson, and Jeffreys British Patent No. 2791, issued Dec. 24, 1902. However, these patents describe a golf ball retriever, fruit grasping tongs, and a ping pong ball retriever and would be unsuitable as a gem holder.

DISCUSSION OF THE DRAWINGS

The foregoing and other objects and advantages of the subject invention will become apparent from the accompanying description and drawings in which.

DESCRIPTION OF THE PREFERRED EMBODIMENT

Figure 1:
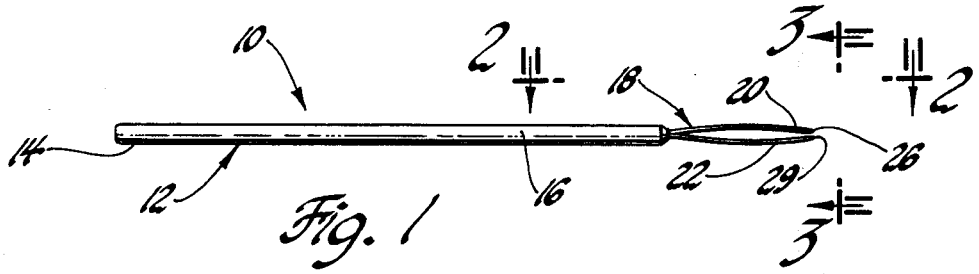
FIG. 1 is a side perspective view of a gem holder embodying the principles of the subject invention.

As shown in FIG. 1, a gem holder 10 is illustrated and includes the handle 12 which has a first end 14 for supporting the handle 12 and a second gem holding end 16 to which is attached a wire array 18 designed to hold a gem.

In the illustrated embodiment the handle 12 is a solid cylindrical material which may readily be made of steel, aluminum, plastic, or other suitably rigid substance. Microscopes commonly employ support apparatus in which a cylindrical shaft may be inserted to support a specimen being examined. It is intended that the diameter of the handle 12 be of such size and configuration as to easily be inserted in such a microscope support apparatus for purposes which will become apparent, though since such support apparatus is common and not part of the subject invention it is not illustrated in the drawings.

The wire array 18 includes a first loop 20 and a second loop 22 attached to the gem holding end 16 of the handle 12. The method of attachment is not important, but if the loops 20 and 22 and handle 12 are made of compatible metal materials a hole can be drilled into the end 16 on the longitudinal axis of the handle 12 to accommodate insertion of the first and second loops 20 and 22 into the end of the handle 12 and a drop of solder can be applied to the end of the handle 12 to surround the loops 20 and 22 and securely attach them to the handle 12.

Figure 2:
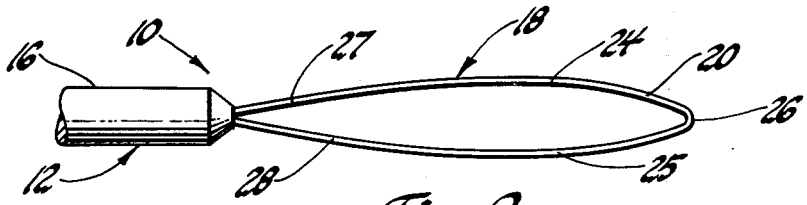
FIG. 2 is an enlarged top view on lines 2—2 of the gem holder in FIG. 1.

FIG. 2 is a top view of the wire array 18 showing the form of the first loop 20 includes two substantially parallel wire sections 24 and 25 connected by an end section 26 at one end and being attached to the handle 12 by connecting sections 27 and 28. In FIG. 2 the second loop 22 would be identical in configuration to the first loop 20 but positioned to be a mirror image of the first loop 20.

Figure 3:
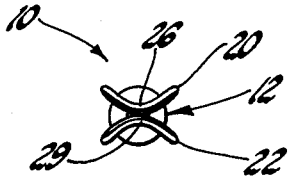
FIG. 3 is an end view on line 3—3 of the gem holder in FIG. 1.

As shown in FIG. 3, the end sections 26 and 29 of the loops 20 and 22 converge toward each other to securely hold a gem.

Figure 4:
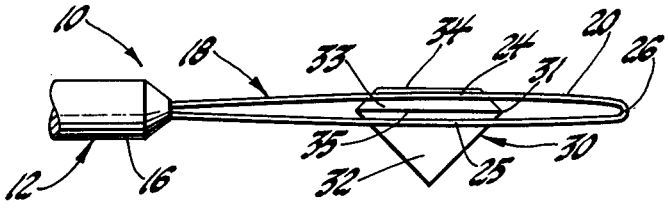
FIG. 4 is an enlarged top view of an alternative embodiment of the gem holder in FIG. 1 showing retention of a gem.

In FIG. 4 the gem holder 10 is the same as the gem holder 10 in FIGS. 1, 2, and 3 except the loops 20 and 22 are narrower. Different types and sizes of gems having various cuts may be more easily held by various gem holder configurations without departing from the spirit of the invention. In FIG. 4, a gem 30 illustrated as being a round cut diamond having a girdle 31, a pavilion 32, a crown 33 and a table 34 is illustrated.

As shown in FIG. 4 a first part 35 of the girdle 31 is positioned between the substantially parallel wire sections 24 and 25 of the first loop 20 a second part of the girdle 31 opposite the first part 35 is positioned between the substantially parallel wire sections of the second loop 22 as a mirror image of the corresponding wire sections 24 and 25 of the first loop 20. Since the end sections 26 and 29 of the first and second loops 20 and 22 are bent toward each other as illustrated in FIGS. 1 and 3, the gem 30 is securely retained in position as shown in FIG. 4. The handle 12 may be inserted in a microscope mounting support as previously described herein so as to facilitate securely holding the gem 30 under the microscope and closely examining the gem 30. The handle 12 may be rotated about its axis between the fingers of the person conducting the examination so as to closely examine all portions of the gem 30. The wire used to form the loops 20 and 22 in the preferred embodiment is made of steel only a few thousandths of an inch thick, thus providing a secure holding mechanism while minimizing obstruction of the gem during the microscopic examination.

For purposes of this specification and the appended claims it should be noted that wires made of materials other than steel, such as aluminum and plastic wires, may be used without departing from the spirit of the invention. It is only required that the wire loops 20 and 22 have sufficient strength to support a gem while having sufficient resiliency to permit spreading the loops apart to permit insertion of a gem between the loops and to resiliently hold the gem by means of spring action between the loops.

Figure 5:
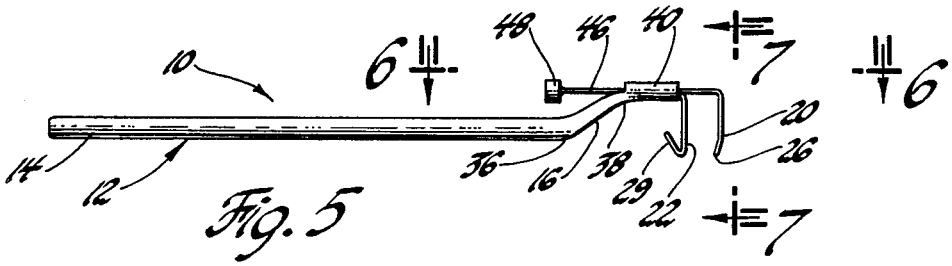
FIG. 5 is a side perspective view of an alternative embodiment of the subject gem holder.
Figure 6:
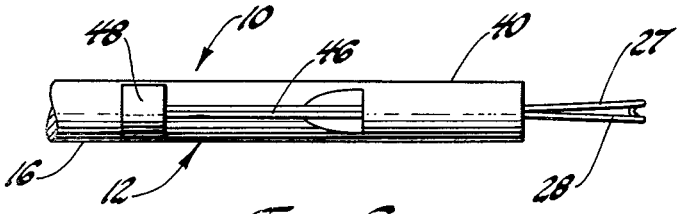
FIG. 6 is an enlarged top view of the gem holder in FIG. 5 along line 6—6.
Figure 7:
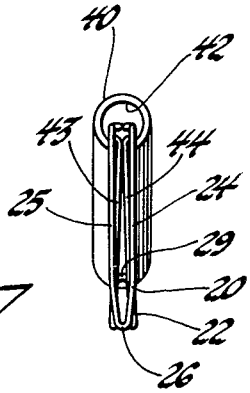
FIG. 7 is an enlarged end view of the gem holder in FIG. 5 taken along line 7—7.

In FIG. 6 an alternative embodiment is illustrated of the subject gem holder 10 in which the gem holding end 16 of the handle 12 is formed to have a first bend 36 and a second bend 38 and a section 40 having an axis parallel to the axis of the first end 14 of the handle 12. The top and end view of the gem holder 10 in FIG. 5 are best shown in FIGS. 6 and 7. In the embodiment of FIGS. 5, 6 and 7 the second loop 22 is securely attached to the end section 40 of the handle 12 such as by soldering as previously described. The second loop 22 includes substantially parallel wire sections 43 and 44 which are at right angles to the longitudinal axes of the support end 14 and end section 40 of the handle 12. The end section 29 of loop 22 is bent toward the handle 12.

In the embodiment illustrated in FIGS. 5, 6 and 7 the first loop 20 has an elongated section 46 slidably positioned in the hole 42.

The elongated section 46 of the first loop 20 terminates in a handle 48 to which it is rigidly attached. The substantially parallel wire sections 24 and 25 of the first loop 20 are substantially at right angles to the elongated section 46 of the first loop 20 and are thus at right angles to the longitudinal axes of the handle 12 first end 14 and end section 40. Thus the wire sections 24 and 25 of the first loop 20 are substantially parallel to the wire sections 43 and 44 of the second loop 22. The end section 26 of the first loop 20 is bent toward the second loop 22. The substantially parallel wire sections 24 and 25 and 43 and 44 extend past the longitudinal axis of the handle 12 first end 14 so that a gem may be inserted between the wire sections 24 and 25 and 43 and 44 in alignment with the handle 12 first end 14 longitudinal axis so that when the handle 12 of the embodiment illustrated in FIGS. 5, 6 and 7 is supported by a microscope support as aforedescribed rotation of the handle 12 about the first end longitudinal axis while viewing the gem which it supports will rotate the gem within the field of view of the microscope. This is the purpose of the offset positioning of handle end section 40. Various sized gems may be accommodated in the embodiment of FIGS. 5, 6 and 7 by grasping the handle 48 and sliding the elongated section 46 of the first loop 20 through the hole 42 until the girdle 31 of a gem 30 is held between the wire sections 24, 25, 43 and 44. The connecting sections 27 and 28 of the first loop 20 diverge so as the first loop 20 is pulled closer to the second loop 22 the connecting sections 27 and 28 are pressed closer together by the interior wall of the hole 42, causing sufficient friction between the loop 20 and the hole 42 to retain the loop 20 in position when the handle 48 is released, thereby resiliently holding a gem 30 between the parallel wire sections 24, 25, 43 and 44. The bent end section 26 of the first loop 20 adds further security to the retention of the gem 30 between the loops 20 and 22.

Persons versed in the art will appreciate that various modifications of the illustrated embodiments of the subject gem holder may be made without departing from the spirit of this invention.

I claim:

1. Apparatus for holding a gem comprising, in combination, a handle and an array of gem holding wires, said handle having a support end and a gem holding end, said array of gem holding wires being secured to said handle gem holding end and including at least four substantially parallel wire sections which are each attached to said handle and between which said gem may be inserted so as to facilitate holding and examining said gem.

2. Apparatus for holding a gem comprising, in combination, a handle and a gem holding wire array, said handle having one end for supporting said handle and a second end for supporting said wire array, said wire array including first and second resilient wire loops which each have two substantially parallel wire sections, all of said parallel wire sections being attached to said handle second end whereby said gem may be inserted in said wire array so as to be resiliently supported between said wire loops and may be examined while said handle is supported.

3. Apparatus for supporting a gem having at least one girdle comprising, in combination, a handle having support and gem holding ends, first and second wire loops attached to and extending from said gem holding handle end, each of said loops having two substantially parallel wire sections which are each substantially parallel to said wire sections in the other of said loops, said substantially parallel wire sections in each of said wire loops being adapted to receive part of said gem girdle between said parallel wire sections whereby said gem may be securely held in said wire array by inserting a first part of said girdle between said wire sections in said one wire loop while simultaneously inserting another section of said girdle between said wire sections in the other of said wire loops so that said wire sections resiliently support said gem.

4. Apparatus for supporting a gem comprising, in combination, a handle having support and gem holding ends; a wire array having first and second wire loops attached to said gem holding end; each of said wire loops having two ends and two substantially parallel wire sections attached at one end to said handle and connected at the other end by a loop end section, at least one of said loop end sections being bent toward the other of said loops whereby said loops are closer spaced at a bent loop end section than at said parallel wire sections, whereby said gem may be supported by said wire loops between said parallel wire sections.

5. Apparatus for supporting a gem comprising, in combination, a handle having support and gem holding ends and a hole in said gem holding handle end defined by an axis; a wire array secured to said gem holding end; said array including a fixed wire loop rigidly secured to said handle gem holding end and a movable wire loop slidably positioned in said handle hole, each of said loops having two substantially parallel wire sections positioned substantially at right angles to said hole axis so that all of said wire sections are substantially parallel and said movable loop wire sections are parallel to and spaced a predetermined distance from said fixed loop wire sections whereby said predetermined distance may be varied by sliding said movable loops axially through said handle hole and said gem may be resiliently supported by said wire array between said loops by positioning said gems between said loops and sliding said movable loop axially through said handle hole until said parallel wire sections in both of said loops resiliently support said gems.

6. Apparatus for supporting a gem having a girdle comprising, in combination, a handle having support and gem holding ends and a hole defined by an axis and a wire array attached to said handle gem holding end; said wire array including a fixed loop rigidly attached to said handle having two substantially parallel wire sections which are connected by an end section and which are each substantially at right angles to said hole axis and a movable loop slidably attached to said handle through said hole and having two substantially parallel wire sections which are substantially parallel to said fixed loop parallel wire sections and which are connected by an end section, said parallel wire sections in each of said loops being adapted to receive part of said gem girdle whereby said gem may be held between said loops by positioning said gem between said loops and sliding said movable loop axially through said hole until both of said loops support said gem girdle between said parallel wire sections in each of said loops.

7. The apparatus of claim 6 in which at least one of said loop end sections is bent toward the other of said loops so that said loops are closer at their end sections than at said parallel wire sections so as to prevent said gem falling out of said wire array.

8. The apparatus of claim 6 in which said handle support end is defined by a first longitudinal axis and said gem holding end of said handle is defined by a second longitudinal axis substantially parallel to said first axis, said longitudinal axes being substantially at right angles to said substantially parallel wire sections, said substantially parallel wire sections extending from said gem holding handle end past said first axis whereby a gem positioned between and held by said substantially parallel wire sections is aligned with said handle support end longitudinal axis.

* * * * *

UNITED STATES PATENT AND TRADEMARK OFFICE

CERTIFICATE OF CORRECTION

PATENT NO. : 4,460,211

DATED : July 17, 1984

INVENTOR(S) : WILLIAM B. POMEROY

It is certified that error appears in the above-identified patent and that said Letters Patent is hereby corrected as shown below:

Column 1, Line 23, change "effected" to---affected---.

Signed and Sealed this

*Eleventh* Day of *December 1984*

[SEAL]

*Attest:*

GERALD J. MOSSINGHOFF

*Attesting Officer*

*Commissioner of Patents and Trademarks*